United States Patent [19]

Franks, Jr.

[11] Patent Number: 4,917,615

[45] Date of Patent: Apr. 17, 1990

[54] GROUND BRACKET

[76] Inventor: George J. Franks, Jr., 664 Thompson Cir., Inverness, Ill. 60067

[21] Appl. No.: 273,257

[22] Filed: Nov. 18, 1988

[51] Int. Cl.[4] ..... H01R 4/36

[52] U.S. Cl. ..... 439/98; 439/814

[58] Field of Search ..... 439/792, 793, 814, 801, 439/810–813, 709, 98

[56] References Cited

U.S. PATENT DOCUMENTS

| | | | |
|---|---|---|---|
| 2,532,068 | 11/1950 | Larsen | 439/811 |
| 2,811,704 | 10/1957 | Newman | 439/814 |
| 3,568,128 | 3/1971 | Taylor | 439/98 |
| 3,760,341 | 9/1973 | Grad | 439/814 |
| 4,325,598 | 4/1982 | Leonards | 439/98 |
| 4,768,963 | 9/1988 | Barron | 439/814 |
| 4,780,096 | 10/1988 | Franks, Jr. | 439/799 |
| 4,784,621 | 11/1988 | Auclair | 439/793 |

FOREIGN PATENT DOCUMENTS

| | | | |
|---|---|---|---|
| 603254 | 8/1960 | Canada | 439/792 |
| 2741791 | 7/1978 | Fed. Rep. of Germany | 439/98 |
| 2713247 | 9/1978 | Fed. Rep. of Germany | 439/98 |
| 60404 | 11/1954 | France | 439/812 |

*Primary Examiner*—Gary F. Paumen

[57] ABSTRACT

A bracket provides a mechanical and electrical connection between a ground wire and a shielded cable. In one embodiment, a portion of the conductive sheath of the shielded cable is placed into an enlarged portion of a keyhole-shaped bore in a lug. The ground wire is placed into a reduced portion of the keyhole-shaped bore. A securing bolt threaded in an intersecting bore in the lug is then tightened to create a mechanical and electrical bond between the conductive sheath and the ground wire. In another embodiment, a pressure plate is placed into an oval shaped bore between the conductive sheath and the securing bolt. When the securing bolt is tightened, a mechanical and electrical connection between the conductive sheath and the bracket is accomplished through the pressure plate. In another embodiment, multiple first bores are fashioned through a lug to accept the ground wire in any of the bores without having to shape the ground wire into a hook-like connector. The securing bolt then engages the ground wire.

12 Claims, 2 Drawing Sheets

FIG. 1
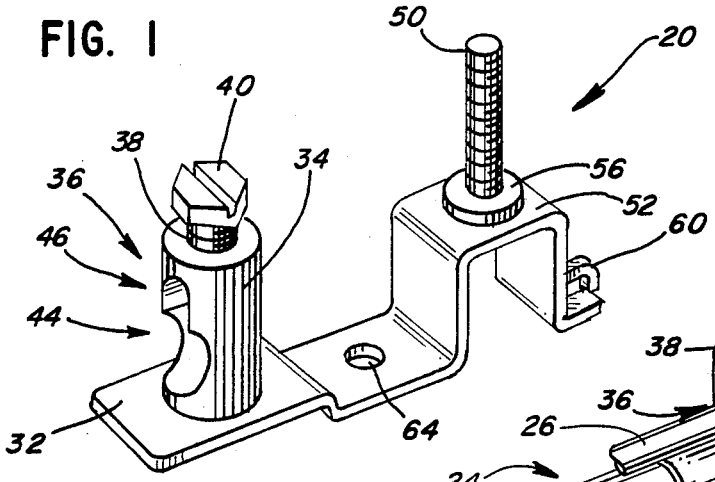
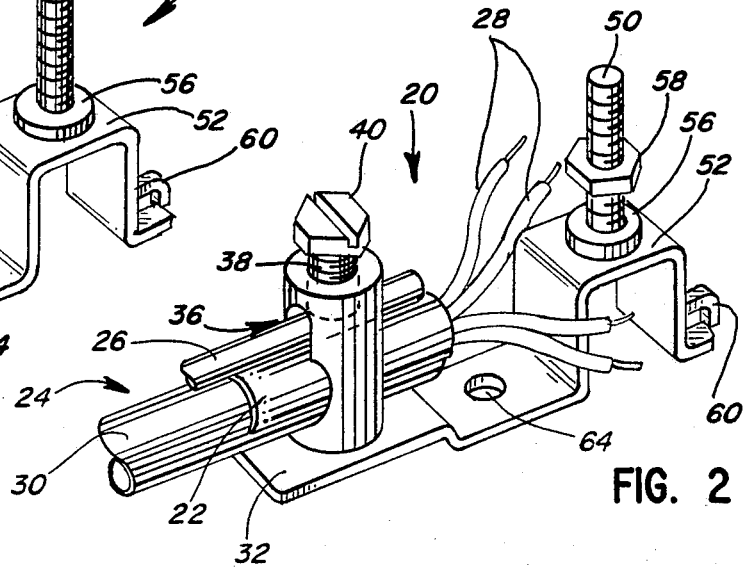
FIG. 2
FIG. 3
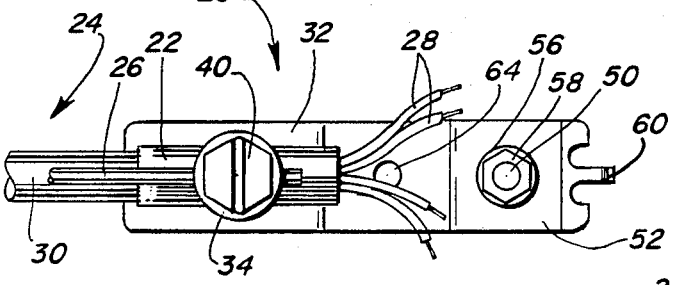
FIG. 4
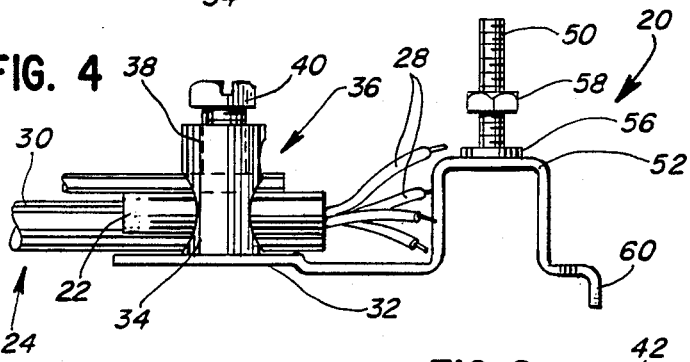
FIG. 6
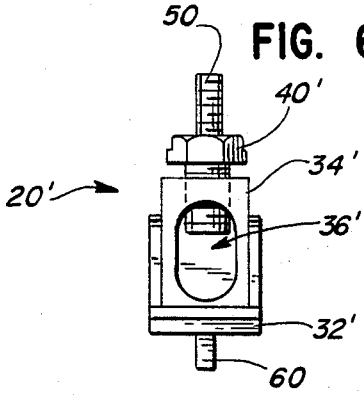
FIG. 8
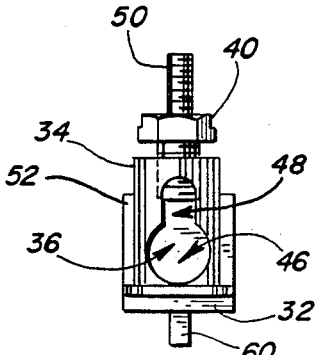
FIG. 5
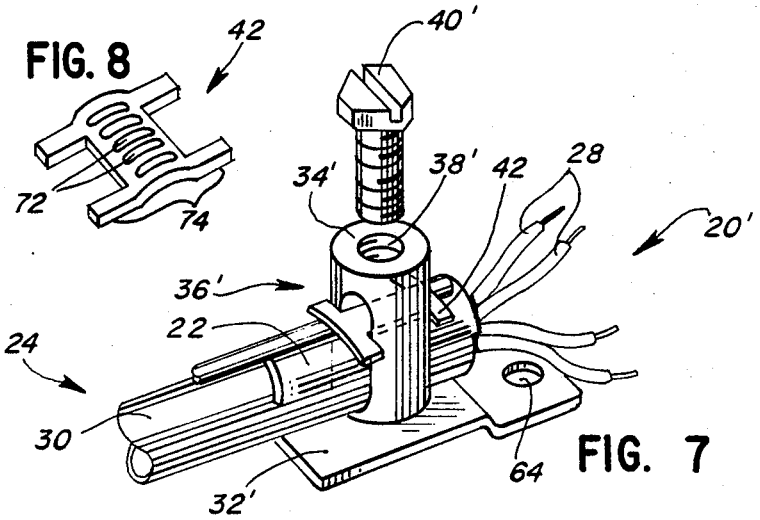
FIG. 7

FIG. 9
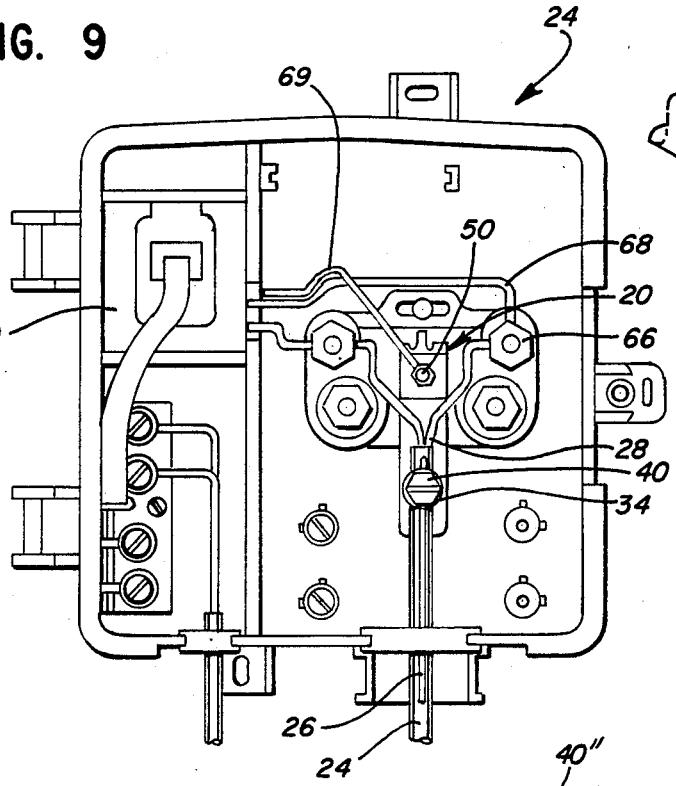
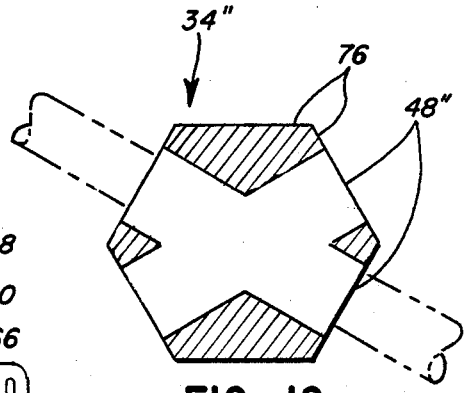
FIG. 12
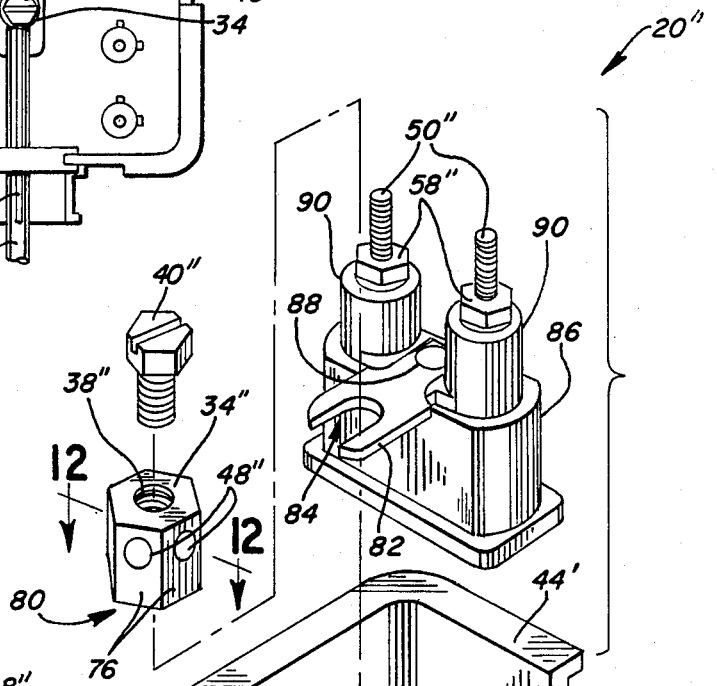
FIG. 10
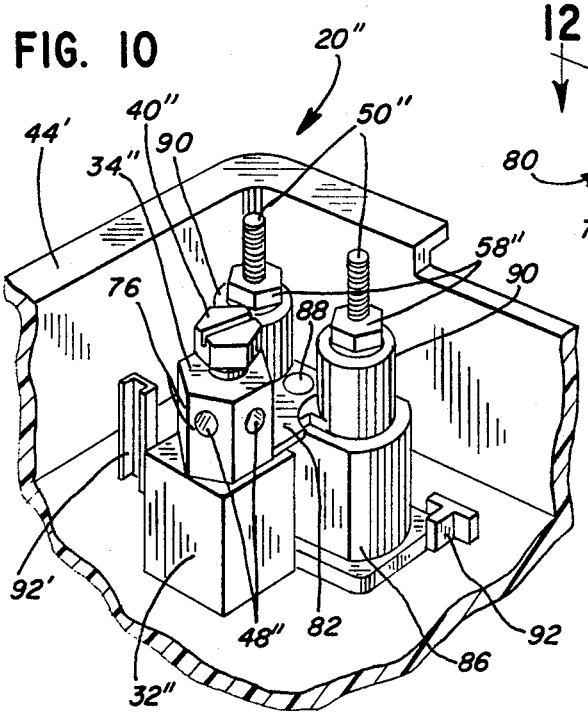
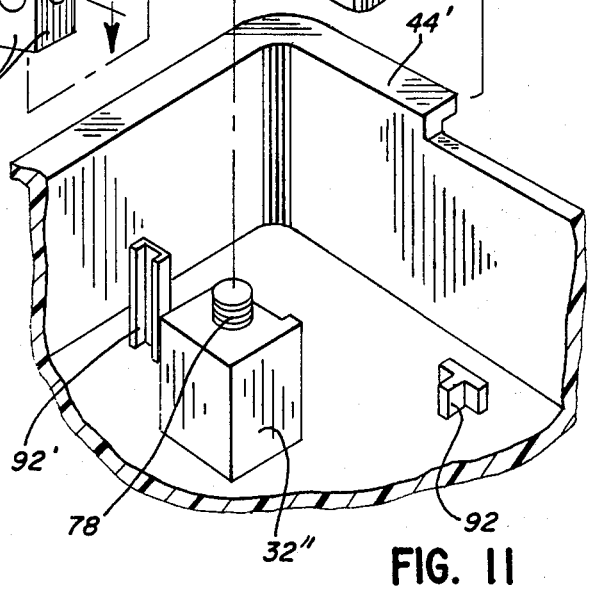
FIG. 11

GROUND BRACKET

FIELD OF THE INVENTION

This invention relates in general to a bracket for providing a mechanical and electrical connection to the conductive sheath of a shielded cable.

BACKGROUND OF THE INVENTION

Several applications exist in which it is necessary to provide a mechanical and electrical connection to the conductive sheath of a shielded cable.

An example of such an application would be in providing telephone service to a building. Typically, one or more telephone lines are contained in a shielded cable running from the external telephone company system into telephone interface equipment located on or in the building. The shielded cable running from the telephone company typically comprises a sheath of electrically conductive material formed around the insulated conductors forming the telephone lines. The conductive sheath is grounded to a ground wire to prevent electromagnetic interference.

The telephone interface equipment where the grounding of the conductive sheath is accomplished is conventional and may take a wide variety of known configurations. After connection to the telephone interface system, each one of the telephone lines to be used to provide telephone service is then connected through conventional wiring to the building phone system.

Other components in the telephone interface equipment must also be grounded to assist in preventing, for example, electromagnetic interference and to prevent damage to the system in the event of lightning.

Grounding of the conductive sheath and of the other components is typically accomplished through electrical connection to a ground wire running from the telephone interface equipment to a separate elongated ground rod sunk into the ground. Typically, a single grounding post is provided in the telephone interface box to which the shielded cable, the ground wire and the various other components to be grounded are all connected. The grounding wire is mechanically and electrically connected to the grounding post, as are the shielded cable and the various components, to accomplish the required ground connection. The grounding post is typically threaded to allow a nut to be tightened onto the grounding post so that all of the components, including the ground wire, are forced in mechanical and electrical contact with one another.

The end of the ground wire has to be bent or shaped into a hook or loop to fit around the grounding post. Due to the heavy gauge of the ground wire, this is a relatively hard task.

To provide an electrical connection between the conductive sheath and the grounding post, a separate bracket is secured to the conductive sheath. The bracket typically has at least one hook-like or hoop-like element which can be placed onto the grounding post. The requisite connection to the bracket is typically accomplished by welding or soldering. The bracket's hook-like or hoop-like element is then secured to the grounding post so that a mechanical and electrical connection is established between the bracket and the grounding post.

While the foregoing bracket and grounding post arrangement provides adequate grounding of the shielded cable, the time, cost and complexity of installation is relatively high. The securing of the bracket to the shielded cable requires a relatively high amount of installation time and skill.

Additionally, a ground bracket which can be either attached to the telephone interface box during manufacture of the box or can be installed as retrofit equipment is desirable.

SUMMARY OF THE INVENTION

In accordance with the present invention, a novel bracket is disclosed which provides an improved mechanical and electrical connection to the conductive sheath of a shielded cable.

The bracket comprises a ground lug or post having a first bore. An exposed portion of the conductive sheath and the ground wire are both placed into and through at least a portion of the length of the first bore. The bore may be keyhole-shaped, having a larger opening capable of receiving the shielded cable and a smaller opening capable of receiving the ground wire. Preferably, the conductive sheath and the ground wire are forced together upon tightening of a lug bolt to accomplish a mechanical and electrical connection between the ground wire and the shielded cable.

In accordance with another embodiment of the invention, the shielded cable is mechanically and electrically secured to the ground lug while the ground wire is mechanically and electrically secured to the bracket at a separate location. A pressure plate is placed in an opening between the conductive sheath and the securing bolt. When the securing bolt is tightened, a mechanical and electrical connection between the conductive sheath and the bracket is accomplished through the pressure plate. The pressure plate may be scored, indented or have some other texture for abrading the surface of the conductive sheath upon tightening, thereby creating a better electrical and mechanical connection.

In accordance with another embodiment of the invention, the ground lug is fashioned with multiple bores, with the ground wire being acceptable by any of the bores. The ground wire may, therefore, be inserted into any of the bores without having to be bent or shaped in any way.

Problems with complex installation of the shielded cable to the ground wire are avoided through use of the novel brackets. The installation of a second hook-like connector to the shielded cable is eliminated since the conductive sheath of the shielded cable is simply exposed and then inserted into the bracket without further modification. The ground wire is also simply inserted into the bracket and secured to provide the ground connection, eliminating the need to mechanically shape the end of the ground wire around a post.

One object of this invention is to provide an improved bracket which provides a mechanical and electrical connection between a ground wire and a shielded cable by inserting each into a single bracket without the need to attach additional connectors to the cable or ground wire.

It is another object of this invention to provide an improved bracket for providing an electrical and mechanical connection between a ground wire and various components in a telephone interface system which can be attached to the telephone interface box during manufacture of the box or, alternatively, can be installed as retrofit equipment.

Other objects and advantages of the invention will become apparent upon the following detailed description with references to the drawings. Throughout the drawings, like reference numerals refer to like parts.

BRIEF DESCRIPTION OF THE DRAWINGS

FIG. 1 is a perspective view of one embodiment of a bracket used to provide an electrical and mechanical connection between a shielded cable and a ground wire;

FIG. 2 is a perspective view of the embodiment shown in FIG. 1 and illustrating the placement of the shielded cable and the ground wire therein;

FIG. 3 is a top view of the embodiment shown in FIG. 2;

FIG. 4 is a side view of the embodiment shown in FIG. 2;

FIG. 5 is an end view of the embodiment shown in FIG. 1 illustrating the key-hole shaped bore;

FIG. 6 is an end view of an embodiment similar to FIG. 1 but illustrating an alternate shape for the bore;

FIG. 7 is a perspective view of another alternative embodiment of the invention using a pressure plate for providing an electrical and mechanical connection to a shielded cable;

FIG. 8 is a perspective view of the pressure plate used in the bracket of FIG. 7;

FIG. 9 is a top view illustrating the bracket of FIG. 2 mounted in a telephone network interface box;

FIG. 10 is perspective view of another alternative embodiment of the ground bracket used for providing an electrical and mechanical connection to a ground wire;

FIG. 11 is an exploded, perspective view of the embodiment shown in FIG. 10; and FIG. 12 is a sectional top view of the ground lug taken along the lines 12—12 in FIG. 11.

DETAILED DESCRIPTION OF THE PREFERRED EMBODIMENTS

Referring generally to all of the drawings, a bracket 20 is illustrated for providing a mechanical and electrical connection to the conductive sheath 22 of a shielded cable 24. A ground wire 26 is placed adjacent conductive sheath 22 and the two components are forced together to accomplish the requisite electrical and mechanical connection. Alternatively, conductive sheath 22 may be mechanically and electrically connected to bracket 20 at one location while ground wire 26 or other components are mechanically and electrically connected to bracket 20 at a different location.

Shielded cable 24 is conventional and can contain a plurality of individual, insulated telephone lines 28. Conductive sheath 22 is formed of electrically conductive material, preferably a copper or alloy thereof, which may be braided and forms a screen around telephone lines 28 to minimize electromagnetic interference. Further, an insulating or protective coating 30 is formed around conductive sheath 22. Protective coating 30 is made of any appropriate insulating material.

A portion of protective coating 30 is stripped from shielded cable 24 to expose a portion of the metallic conductive sheath 22. The exposed portion of conductive sheath 22 can alternatively be left stripped or be folded back along the length of shielded cable 24. The conductive sheath 22 must be mechanically secured and electrically connected to the ground wire 26. This is the purpose of the novel bracket 20.

Bracket 20 has a base 32 having an upright post or ground lug 34. Ground lug 34 has a first bore 36 into which shielded cable 24 and ground wire 26 are both inserted. Alternatively, either shielded cable 24 or ground wire 26 is inserted into first bore 36 in alternate embodiments to be explained later. A second bore 38, normal to bore 36, extends from the top of post 34 and intersects first bore 36, and is fashioned to receive a securing bolt 40. After the exposed portion of the conductive sheath 22 and/or ground wire 26 is inserted into first bore 36, securing bolt 40 is tightened to force conductive sheath 22 and ground wire 26 together to form the desired mechanical and electrical connection.

Alternatively, the securing bolt 40 and ground lug 34 are forced into contact with either conductive sheath 22 and/or ground wire 26. If only conductive sheath 22 is inserted into first bore 36, a pressure plate 42, FIGS. 7–8, is placed between conductive sheath 22 and securing bolt 40 to accomplish a better mechanical and electrical connection to the sheath 22. Pressure plate 42 has a surface adjacent conductive sheath 22 which is scored or textured to abrade the surface of conductive sheath 22 upon tightening, thereby creating a better electrical and mechanical connection while preventing the cable 24 from being crushed by the securing screw 40.

The bracket 20 has utility for any application where a shielded cable 24 is to be mechanically and electrically connected to a ground wire 26 or other components. The shielded cable 24 is secured to bracket 20 while ground wire 26, for example, can be secured to bracket 20 at the same or at a different location on bracket 20 than shielded cable 24. Likewise, other components can be electrically connected to either shielded cable 24 or ground wire 26 by themselves being mechanically and electrically connected to bracket 20 as in a telephone interface box 44 as illustrated in FIG. 9.

Considering the invention in more detail, FIGS. 1–5 show a first embodiment of bracket 20 for securing the ground wire 26 to the exposed portion of the conductive sheath 22 of the shielded cable 24. Bracket 20 is formed of electrically conductive metal and has a base 30. The exact shape of the bracket 20 will vary depending on the requirements of the telephone interface box 44, see FIG. 9, into which the bracket is mounted. Certain interface phone boxes will require raised platforms for grounding to additional wires, and clearances for other cables and the like, which configurations will vary depending on the requirements of the particular interface box and the particular manufacturer of the box. The bracket 20 can be adopted to a variety of shapes and the shapes shown are illustrative only.

Ground lug 34 is mounted along base 32. Ground lug 34 may, for example, be welded or brazen to base 32. Ground lug 34 has a first bore 36 and a second bore 38. First bore 36 and second bore 38 are preferably substantially perpendicular to each other. First bore 36 is also preferably keyhole-shaped having an enlarged shielded cable acceptor portion 46 and a reduced ground wire acceptor portion 48. Both acceptor portions 46 and 48 must be of sufficient cross-sectional area to accept therein shielded cable 24 and ground wire 26, respectively. Both acceptor portions 46 and 48 are of only slightly larger cross-sectional area than the shielded cable 24 and ground wire 26 so that each is held in the acceptor portions snugly without much free space around each, whereby shielded cable 24 and ground wired 26 are kept relatively in place during securing. Alternatively, as illustrated in FIG. 6, first bore 36, is not keyhole-shaped but is more uniformly shaped intermediate its top and bottom to accept a larger diameter ground wire or several ground wires therein. A pressure plate 42 as illustrated in FIGS. 7–8 may also be utilized as will be explained later.

Second bore 38 is formed to intersect the ground wire acceptor portion 48 and is threaded to receive securing bolt 40. Securing bolt 40 is itself threaded and of sufficient length to extend through second bore 38 and into first bore 36. Securing bolt 40 is made of an electrically conductive material, such as brass.

The end of shielded cable 24 is placed through first bore 36 into cable acceptor portion 46 so that a portion of conductive sheath 22 rests in acceptor portion 46. Ground wire 26 is placed into ground wire acceptor portion 48. A portion of ground wire 26 must be in contact with conductive sheath 22. Preferably, both the exposed portion of conductive sheath 22 and ground wire 26 pass entirely through first bore 36. Ground wire 26 preferably lies on top of the exposed portion of conductive sheath 22, as illustrated in FIGS. 2–4. After shielded cable 24 and ground wire 26 are placed in first bore 36, securing bolt 40 is tightened to form the desired mechanical and electrical connection.

A grounding post 50 is attached to platform 52 and positioned generally upright therefrom. Grounding post 50 is made of an electrically conductive material, such as brass. Grounding post 50 can be threaded and screwed through grounding post aperture 54 (see FIG. 11). Alternatively, as illustrated in FIGS. 1–5, grounding post 50 and/or post head 56 can be welded or brazen to base 32.

Grounding post 50 is threaded to receive a nut 58. Nut 58 is movable substantially along the length of grounding post 50. As explained below, grounding post 50 is useful for providing an electrical connection between ground wire 26 and other components.

Bracket 20 may be mounted in a telephone interface box 44, see FIG. 9, to provide a mechanical and electrical ground connection between grounding wire 26 and various components located in box 44, including shielded cable 24. The possible designs for box 44 vary greatly. For example, the location of entry for either shielded cable 24 or ground wire 26 into box 56 may vary. Further, the design of box 44 may require a different shape of bracket 20 than described above.

The bracket 20 can be sold as original equipment and installed during the manufacture of the interface box 44. Alternatively, bracket 20 can be sold as retrofit equipment. As retrofit equipment, the old bracket previously installed can be removed and bracket 20 installed in its place. For example, at the time of installing a new shielded cable 24 containing telephone lines 28 into an existing interface box, the old bracket which required a hook connection to the shielded cable can be discarded. The new bracket of the present invention can be mounted in the box, allowing a simplified connection to the new cable 24 by merely stripping back the protective coating 30 and inserting the exposed sheath 22 into the keyhole-shaped opening of the bracket of FIGS. 1–5, along with the ground wire 26 to be connected thereto.

Base 32 is secured to box 44, as illustrated in FIG. 9, by any one or more of several known means. For example, stake 60 formed at one end of bracket 20 is placed into a positioning hole 62 in the bottom of box 44, and a securing screw (not shown) is inserted through bracket attachment hole 64, FIGS. 1–3.

After bracket 20 is secured to box 44 in any way suitable, the bracket 20 is used to provide a ground connection to other components in box 44. A second, additional ground wire 69 is attached at one end to grounding post 50 and at its other end to the component (not shown) to be grounded. The telephone lines 28 are connected, as seen in FIG. 9, to other posts via nuts 66 and through wires 68 to modular equipment 70 within the box, as is conventional.

Referring to a another embodiment of the invention illustrated in FIGS. 7–8, a similar mechanical and electrical connection is provided by bracket 20', between conductive sheath 22 of shielded cable 24 and ground lug 34', Ground lug 34', is provided with first bore 36', having a cross-sectional area sufficient to accept shielded cable 24 therethrough. First bore 36' is not keyhole-shaped but oval.

A pressure plate 42 is placed into first bore 36' between conductive sheath 24 and securing bolt 40', When securing bolt 40', within second bore 38' is tightened, a mechanical and electrical connection is accomplished through pressure plate 42 to bracket 20', without crushing the cable 24 because the plate spreads the pressure exerted by bolt 40'. The surface of pressure plate 42 adjacent to and contacting conductive sheath 24 contains indentations 72 to abrade conductive sheath 24 upon tightening to better establish the requisite connection. The indentations 72 extend across the plate 42 and transverse to the longitudinal direction of cable 24 to help prevent the cable from being pulled out of the bracket after tightening of screw 40'. The indentations 72 may be stamped into plate 42, or formed by serrations on the bottom or scoring on the bottom which engages the shielded conductor 22. Each end of plate 42 has legs 74, which retain plate 42 within the first bore 36'. The ends of the legs 74 are upturned slightly to increase the clearance or height between the legs 74 and the bottom of bracket 20', thus allowing a smaller diameter cable to be placed within the bore and secured by the pressure plate 42 before legs 74 touch the bottom of the plate 42. The plate 42 may be formed of half hard brass.

Referring to a third embodiment of the invention illustrated in FIGS. 10–12, an improved mechanical and electrical connection is provided between ground wire 26 and ground lug 34''. Ground lug 34'' is provided with two ground wire acceptor portions 48'' formed at least a portion of the way through ground lug 34'', preferably therethrough. Ground wire 26 is insertable into either ground wire acceptor portion 48''. Securing bolt 40'' within second bore 38'' is then tightened to secure ground wire 26 to ground lug 34''.

Ground wire acceptor portions 48'' are both of a shape and diameter sufficient so that ground wire 26 may be accepted into either ground wire acceptor portion 48''. Ground wire acceptor portions 48'' are circular-shaped or oval-shaped. Preferably, ground wire acceptor portions 48'' have a diameter slightly larger than the diameter of ground wire 26.

Ground wire acceptor portions 48'' can be formed in adjacent vertical faces 76 of ground lug 34'', FIGS. 10–12, or ground wire acceptor portions 48'' can be formed through vertical faces 76 not adjacent to each other. Further, ground wire acceptor portions 48'' do not need to be formed to intersect each other. Preferably, the center line of each ground wire acceptor portion 48'' rests in the same plane.

The second bore 38'' must intersect each ground wire acceptor portion 48'' so that securing bolt 40'' is then capable of being tightened to secure ground wire 26 to ground lug 34''.

Lug 34'' is connected to a base 32'' by any one of a number of ways. As illustrated in FIG. 11, lug 34'' is secured to base 32'' by securing bolt 78. Securing bolt 78 is attached to base 32'' and base 32'' is attached to box 44'. Lug 34'' has a third bore 80 which is formed and threaded to receive securing bolt 78. As base 32'' is threaded on bolt 78 and tightened, the bores 48'' may line up or orient differently with respect to the opening in the interface box 44 through which the ground wire is inserted.

The purpose for providing more than one ground wire acceptor portion 48'' is to provide the human installer with flexibility as to where to insert ground wire 26 into ground lug 34''. The human installer, for example, does not have to bend ground wire 26 to fit into a single ground wire acceptor portion 48'' if the other ground wire acceptor portion 48'' is better oriented to accept ground wire 26.

Ground wire 26, as secured to lug 34'', is used to ground other electrical conductors. Arm 82 is secured against base 32'' by the tightening of lug 34'' on securing bolt 78. Arm 82 has an indentation 84 which fits around securing bolt 78. Arm 82 is itself attached along its length to carriage 86 by rivet 88. Carriage 86 has two columns 90 upon which grounding posts 50'' with nuts 58'' are attached. Grounding posts 50'' are therefore electrically connected to arm 82. When an electrical conductor (not shown) is secured to either or both grounding posts 50'', a ground connection is provided between ground wire 26 and the electrical conductor.

Carriage 86 is positioned within box 44' with positioning blocks 92 and 92' on box 44'. Carriage 86 is further held in place by the securing of arm 82 to base 32''. Again, the exact configuration of the bracket will vary greatly dependent upon the details of the telephone mounting box.

While the invention is described in connection with preferred embodiments, it will be understood that it is not intended to limit the invention to those embodiments. On the contrary, it is intended to cover all alternatives, modifications and equivalents as may be included in the spirit and scope of this invention as defined by the appended claims.

What is claimed is:

1. A bracket for mechanical and electrical connection between a conductive sheath of a shielded cable and a ground wire, comprising:

a lug having a first, generally keyhole-shaped bore formed therein, the keyhole-shaped bore including an enlarged portion only slightly larger than the diameter of an exposed portion of the conductive sheath of the shielded cable and a reduced portion only slightly larger than the diameter of the ground wire, a second bore formed to extend into the first bore; and means in said second bore which forces the ground wire into engagement with the exposed portion of the conductive sheath of the shielded cable with the keyhole-shaped bore snugly holding the ground wire and shielded cable during engagement to thereby form an electrical connection between the conductive sheath and the ground wire.

2. The bracket of claim 1 further comprising a base to which the lug is attached and a post electrically connected to the lug through the base.

3. The bracket of claim 1 wherein the second bore is formed substantially perpendicular to the first bore and wherein said second bore is formed to extend through to said reduced portion.

4. The bracket of claim 3 wherein the second bore has a threaded opening and the forcing means comprises a threaded bolt.

5. The bracket of claim 1 wherein the forcing means comprises a bolt which contacts the ground wire and forces it into engagement with the sheath of the shielded cable.

6. The bracket of claim 1 further comprising a stake for positioning the bracket in a telephone interface box.

7. A bracket for mechanical and electrical connection between a conductive sheath of a shielded cable, a ground wire and at least one other conductor, comprising:

a base of electrically conductive material;

a lug of electrically conductive material and electrically connected to the base, the lug having a first bore which accepts both the exposed portion of the conductive sheath of the shielded cable and the ground wire simultaneously, a second bore formed to extend to the first bore including a plate movably disposed int he first bore and located between the shielded cable and the threaded bolt to spread the pressure of the bolt over the exposed portion of the conductive sheath; and a threaded bolt moveable in the second bore and of sufficient length which forces the exposed portion of the conductive sheath of the shielded cable and the ground wire into electrical contact with each other.

8. The bracket of claim 7 wherein the first bore is generally keyhole-shaped having an enlarged portion capable of receiving the shielded cable and a reduced portion capable of receiving the other conductor.

9. The bracket of claim 8 wherein the reduced portion is only slightly larger than the diameter of the ground wire.

10. The bracket of claim 7 wherein the first bore is substantially perpendicular to the second bore.

11. The bracket of claim 7 wherein the first bore is elongated in shape and has opposed sides which are substantially parallel to each other.

12. The bracket of claim 7 wherein the bolt contacts the ground wire to force the ground wire against the shielded cable.

* * * * *